US005875723A

United States Patent [19]

Lobur

[11] Patent Number: 5,875,723

[45] Date of Patent: Mar. 2, 1999

[54] PORTABLE CARPET BINDING MACHINE

[75] Inventor: Terry Lobur, Seven Hills, Ohio

[73] Assignee: Binders Group, Inc., Parma, Ohio

[21] Appl. No.: 8,612

[22] Filed: Jan. 17, 1998

[51] Int. Cl.[6] ..... D05B 27/14; D05B 35/06; D05B 57/02

[52] U.S. Cl. ..... 112/7; 112/137; 112/169; 112/199; 112/322

[58] Field of Search ..... 112/7, 9, 10, 11, 112/136, 137, 152, 199, 248, 241, 169, 318, 322

[56] References Cited

U.S. PATENT DOCUMENTS

| | | | |
|---|---|---|---|
| 5,209,171 | 5/1993 | Anderson | 112/7 |
| 5,660,128 | 8/1997 | Wokeck | 112/318 |
| 5,732,640 | 3/1998 | Mizusaki et al. | 112/248 |

OTHER PUBLICATIONS

*Union Special Stitch Formation Type 401* (*booklet*), Union Special Corp. (1976).

*Parts Chart for Consew Model 224, 224R–1, 225, 226R–1* (*chart*), Consew (date of publication unknown).

*Portable Bag Closer Model NP–8.* Newlong Machine Works, Ltd., Ctg. No. FK–0101–NL–NLN (1990).

*Portable Bag Closer Model NP–3II.* Newlong Machine Works, Ltd., Ct. No. C4005–E–N (1986).

*Portable Bag Closer Model NP–7A.* Newlong Machine Works, Ltd., Ctg. No. C4006–E–N (1985).

*Newlong Model NP–3II Portable Bag Closure Instruction Manual/Parts List, No. 4,* Newlong Machine Works, Ltd., Ct. No. P2017K 94–12–300F (1992).

*Union Special Industrial Sewing Machines, Class 51300,* Union Special Machine Co., Ct. No. 249 (Jun. 1967).

*Union Special Industrial Sewing Machines, Style 51800BA,* Union Special Machine Co., Ct. No. 104R (1961).

*Everything for Carpet Binding, Fringing, Serging, Carving, Cutting, Beveling and Custom Carpet Applications,* N–C Carpet Binding & Equipment Corp., Ctg. No. 50M91 (date of publication unknown).

*N–C Master Finish by Munsinger,* N–C Carpet Binder & Equipment Corp., one–page flyer (date of publication unknown).

*Sisal Binder Model 81200–S,* N–C Carpet Binder & Equipment Corp., one–page flyer (date of publication unknown).

*N–C Capret Cove Base Cutters,* N–C Carpet Binding & Equipment Corp., two–page flyer (date of publication unknown).

*Union Special Industrial Sewing Machines, Class 56100,* Union Special Machine Co., Ctg. No. 130M (1965).

*Primary Examiner*—Peter Nerbun

*Attorney, Agent, or Firm*—Watts, Hoffmann, Fisher & Heinke, Co., L.P.A.

[57] ABSTRACT

A portable carpet binding machine comprising a housing defining an interior region, a drive mechanism supported by the housing and at least partially disposed in the interior region, a prime mover operatively coupled to the drive mechanism for providing motive power to the drive mechanism, a sewing assembly driven via the drive mechanism for sewing a strip of material to a piece of carpet, the sewing assembly including a binder guide, a sewing needle and a looper, the binder guide operating to fold the strip of material around an edge portion of the piece of carpet, the sewing assembly, when driven, operating to stitch the strip of material to opposite sides of the edge portion of the piece of carpet using first and second pieces of thread. The portable carpet binding machine includes a carpet feeding assembly including a feed driver mechanism and a coacting puller mechanism operating in substantially synchronous movement to linearly feed the piece of carpet relative to the sewing assembly. The feed driver mechanism includes a feed-dog driven via the drive mechanism that intermittently engages the bottom of the piece of carpet to thereby advance the piece of carpet forward. The coacting puller mechanism includes a feed roller driven via the drive mechanism that intermittently engages the bottom of the piece of carpet which, in turn, pulls the piece of carpet forward substantially simultaneously with respect to the advancement by the feed-dog of the feed driver mechanism.

22 Claims, 9 Drawing Sheets

40
160
158
A
157
156
152
C 102
102a
161
106
102b
103
109
146
147
145
148
155
140
152
C 106
130
161
146
145
147
C
152
148
140
8B
8B 165
144a
142
144
20
174
171
143
166
168
170
143
180
178
141
143
B 142
144a
13
20
165
171
143
174
144
13
166
168
143
180
178
170
143
141
B 142
20
144a
143
171
165
174
166
170
168
178
180
143
141
B

PORTABLE CARPET BINDING MACHINE

FIELD OF THE INVENTION

The present invention relates to sewing machines and, more particularly, to sewing machines adapted to sew binding material onto carpet edges.

BACKGROUND OF THE INVENTION

Carpet binding machines are used to sew binding material, or tape, to the top and bottom of a piece of carpet to bind the edge of the carpet. Oftentimes, in a wall-to-wall carpet installation, a four or six inch strip of contrasting carpet will be used as coving instead of wood or rubber cove molding. In such an installation, the upper edge of the carpet cove needs binding material sewn thereon to present a finished appearance and so that the edge does not unravel. The stitch utilized by most carpet binding machines is the type 401 chain stitch because of its streamlined appearance and effective binding capability.

Carpet binding machines are generally classified as being portable or stationary. Stationary machines are heavy, often weighing between 55 and 65 pounds. The weight of such machines forces them to be used at a single location, for example, in a carpet installer's warehouse, to sew binding material onto a carpet edge. While such machines tend to be durable, their lack of portability limits their usefulness in situations where the carpeting cannot be precut into appropriate length pieces for the job and bound in the installer's warehouse. Also, such stationary machines tend to be costly compared to their portable counterparts.

Portable carpet binding machines have the advantage of being capable of being transported and used at installation sites by installers. They do not require the carpeting to be precut and prebound as with a stationary machine and are lower in cost than stationary machines. However, the durability and reliability of prior art portable carpet binding machines has been unsatisfactory.

Portable carpet binding machines are manufactured by modifying a standard household sewing machine. While such sewing machines are suitable for sewing clothes and similar light fabrics, subjecting such machines to the rigors of sewing carpeting characterized by heavy backing material and a plush pile results in an undesirable rate of skipped or otherwise malformed stitches, carpet feed problems, or even sewing machine breakdowns.

A skipped or malformed stitch can be corrected at the installation site. However, because such problems recur with frequency, oftentimes taking the time to restitch a piece of carpet can result in substantial delays and inconvenience.

A skipped stitch may occur in a type 401 stitch sewing cycle, for example, if the needle loop is not properly formed and the looper misses the opening of the needle loop as a result. Because portable carpet binding machines typically use a plastic needle thread, there is a greater tendency for the needle thread to flex in an unpredictable manner and, therefore, create unpredictable sewing results. Oftentimes, a single skipped stitch will cause the succeeding stitch to be missed because the previously improperly formed needle loop generates additional slack in the needle thread making it difficult to form the next needle loop. A series of missed stitches can cause an unsightly gap in the stitching of the binding material and a risk of the carpet edge unraveling.

A malformed stitch may occur, for example, if there is too much slack in the needle thread or looper thread. A household sewing machine incorporates thread take-up mechanisms to remove slack in the threads. These thread take-up mechanisms, however, are not designed to be used in a portable carpet binding machine. Some prior art portable carpet binding machines that modify such household sewing machines fail to adequately modify the thread take-up mechanism which, in turn, can cause such malformed stitches.

A malformed stitch can also occur when the piece of carpet is not fed properly through the sewing machine. Portable carpet binding machines that are made from a modified household sewing machine utilize what is known in the art as a presser foot and feed-dog to feed the carpet. It has been found that this single feed assembly is unsatisfactory for feeding a piece of carpet. Furthermore, the rigors of carpet binding may subject components of the machine to undue stress and cause excessive wear or failure in the components.

Since most carpet installers can only afford a single carpet binding machine, a breakdown of the machine requires the installer to quit working on the installation, take the machine to a repair shop, procure needed repairs and then return to the installation site to finish the job. The downtime of a portable carpet binding machine, whether due to restitching or repairing, results in downtime of the installer in addition to the expense of repair of the machine. Since most installers are paid by the job, downtime has a direct impact on the number of jobs completed by the installer and his or her net income.

What is needed is a portable carpet binding machine that is adapted to sewing light or heavy pile carpeting, that is lightweight and that is more durable and reliable than prior art portable carpet binding machines. Such a machine must also be easy to manufacture and repair and be competitively priced with prior art portable carpet binding machines.

SUMMARY OF THE INVENTION

The present invention is directed to a portable carpet binding machine that is adapted to bind binding material, or tape, to the edge of light or heavy carpeting. The portable carpet binding machine is durable, lightweight (weighing about 18 pounds) and is easy to manufacture using known manufacturing techniques. Its design also facilitates easy repair of worn out or damaged working components of the machine.

The portable carpet binding machine includes a housing defining an interior region. The housing supports two rolls of thread and a coil of binding material. A distal end of the first roll of thread is threaded through a needle of the sewing assembly while a distal end of the second roll of thread is threaded through a looper of the sewing assembly. The binding material is sewn to the top and bottom to bind the edge of the piece of carpet using a chain stitch known as a type 401 double locked chain stitch to those skilled in the art.

The housing is supported on rollers permitting the machine to move with respect to a stationary piece of carpet to be bound. Alternately, if the piece of carpet to be bound is relatively small, the carpet binding machine may be held stationary and the carpet fed through the machine.

Extending from the housing is also a handle to aid in positioning the machine as desired and carrying the machine between locations at an installation site. The housing supports a finger trigger switch for activating the drive mechanism. Advantageously, the trigger switch can be locked into an "on" position and a microswitch is provided for actuating the machine when carpet is fed into the sewing assembly.

A drive mechanism is supported by the housing and at least partially disposed in the interior region. A prime mover is operatively coupled to the drive mechanism for providing motive power to the drive mechanism. In the preferred embodiment, the prime mover comprises an AC 60 watt series motor. In the preferred embodiment, a potentiometer is operative to vary the speed of the prime mover and, consequently, the speed of the drive mechanism.

The drive mechanism drives a sewing assembly. The sewing assembly is operative to sew a strip of material to a piece of carpet. The sewing assembly includes a binder guide, a sewing needle and a looper. The binder guide operates to fold the strip of material around an edge portion of the piece of carpet. A first piece of thread is threaded through an aperture of the needle and a second piece of thread is threaded through an aperture of the looper. The sewing assembly, when driven by the drive mechanism, is operative to stitch the strip of material to opposite sides of the edge portion of the piece of carpet using the first and second pieces of thread.

The present invention also includes a carpet feeding assembly. The carpet feeding assembly includes a feed driver mechanism and a coacting puller mechanism that operate in substantially synchronous movement to linearly feed the piece of carpet relative to the sewing assembly. The feed driver mechanism includes a feed-dog that is driven via the drive mechanism and that intermittently engages the bottom of the piece of carpet which, in turn, advances the piece of carpet forward.

The coacting puller mechanism includes a feed roller driven via the drive mechanism that intermittently engages the bottom of the piece of carpet which, in turn, pulls the piece of carpet forward substantially simultaneously with respect to the advancement by the feed-dog of the feed driver mechanism.

According to another feature of the invention, the coacting puller mechanism further includes a presser roller for providing a predetermined amount of downward force opposite the feed roller so that the piece of carpet is engaged therebetween. A spring biases the presser roller downwardly. A clutch is operatively connected to the feed roller for providing intermittent rotation to the feed roller.

According to yet another feature of the invention, the looper includes a top and bottom and a tip and heel. The bottom of the looper includes a leaf spring attached thereon near the heel of the looper. The leaf spring extends from the heel to the tip of the looper and flares away from the bottom of the looper near the tip of the looper. The sewing assembly is operative to stitch the strip of material to opposite sides of the edge portion of the piece of carpet by interlooping the first and second threads. During at least a part of the interlooping operation, the first thread forms a loop of first thread through which the looper advances such that as the looper retracts from the loop of first thread the leaf spring operates to retard movement of the loop of first thread as the loop of first thread slides towards the tip of the looper.

According to yet another feature of the invention, the needle includes a front side and a back side. The first thread is threaded along the front side of the needle, through the aperture of the needle and along the back side of the needle. The second thread is threaded through the aperture of the looper. The needle is operative during a forward stroke to penetrate through the first material and the second material and move the first thread a predetermined distance below the second material. During its return stroke the needle is operative to retract from the first and second materials thereby forming below the second material a loop of first thread. The looper is operative to advance through the loop of first thread.

The portable carpet binding machine also includes a loop deflector driven by the drive mechanism. The loop deflector operates in proximity to the front side of the needle such that as the needle makes its return stroke the first thread is deflected from passing to the front side of the needle and passes to the back side of the needle which, in turn, forms the loop of first thread on and extending away from the back side of the needle.

According to yet another feature of the invention, the sewing assembly includes a looper thread take-up. A needle thread is threaded through an aperture of the needle and a looper thread is threaded through an aperture of the looper and extends to and through an aperture of the thread take-up.

The drive mechanism is operative to drive the needle in an upward and a downward stroke, the looper in an advance motion and a retraction motion in substantial unison with the respective upward and downward strokes of the needle, and the looper thread take-up in a curved upward and curved downward motion in substantial unison with the respective upward and downward strokes of the needle and a linear forward and a linear return motion in substantial unison with the respective advance and retraction motions of the looper.

The looper thread take-up is operative in the curved downward motion to remove remaining slack in the looper thread drawn from a previous sewing cycle and to subsequently draw additional looper thread for a subsequent sewing cycle. In the linear return motion, the looper thread take-up is operative to provide the required slack in the looper thread for the retraction motion of the looper. In the linear forward motion, the looper thread take-up is operative to provide the required slack in the looper thread for the advance motion of the looper, and in the curved upward motion to provide the required slack in the looper thread for completing a sewing cycle.

Additional features will become apparent and a fuller understanding obtained by reading the following detailed description made in connection with the accompanying drawings.

DETAILED DESCRIPTION

Figure 1:
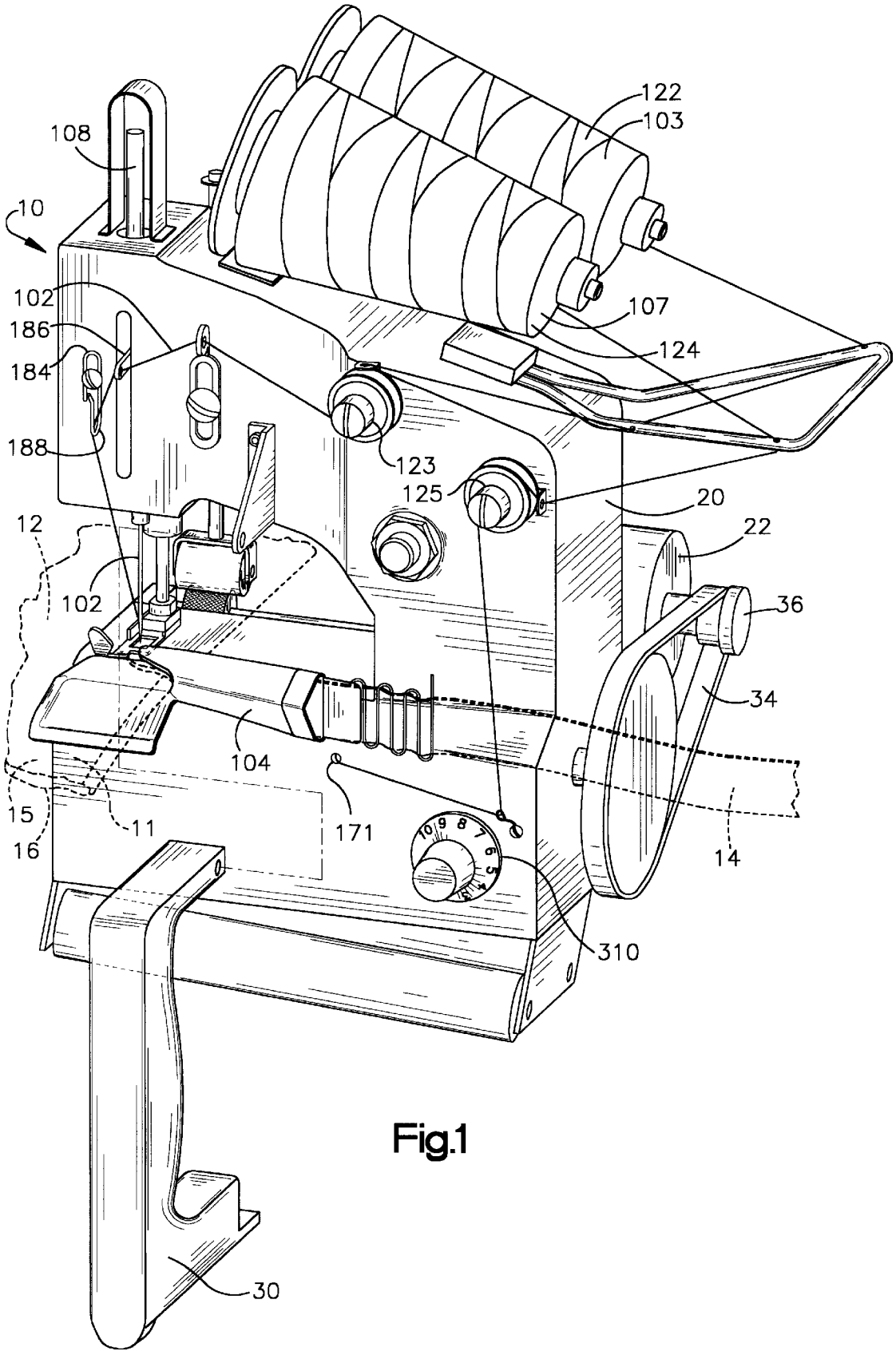
FIG. 1 is a perspective view of the portable carpet binding machine of the present invention shown sewing binding material to a strip of carpeting.

A portable carpet binding machine of the present invention is shown generally at 10 in FIG. 1. To describe the features of the present invention the illustrated embodiment shows a Newlong Model NP-3II portable bag closing machine with modifications thereto. However, it should be understood by those skilled in the art that the present invention is adaptable to any type of sewing machine.

The machine 10 is shown binding a cut edge 11 of a piece of carpet 12. The binding process involves sewing a binding material 14 to the top 15 and bottom 16 of the piece of carpet 12 so that the binding material 14 overlies the cut edge 11 of the piece of carpet 12. Typically, the binding material 14 is ⅞ inch wide but can vary from ¾ inch to 1 ¼ inches. The carpeting 12 is a strip four to six inches in width. Such a carpet strip 12 is used for coving in a wall-to-wall carpet installation, but it should be understood that the machine 10 will function to sew binding material to a peripheral edge of any size piece of carpet 12.

The machine 10 includes a housing 20 and an AC motor 22 attached to and extending from the housing 20. A drive belt 34 is driven by a pulley shaft 36 of the motor 22. The housing 20 supports a handle 30 used to position the machine 10 and carry the machine 10 between job locations.

Figure 2:
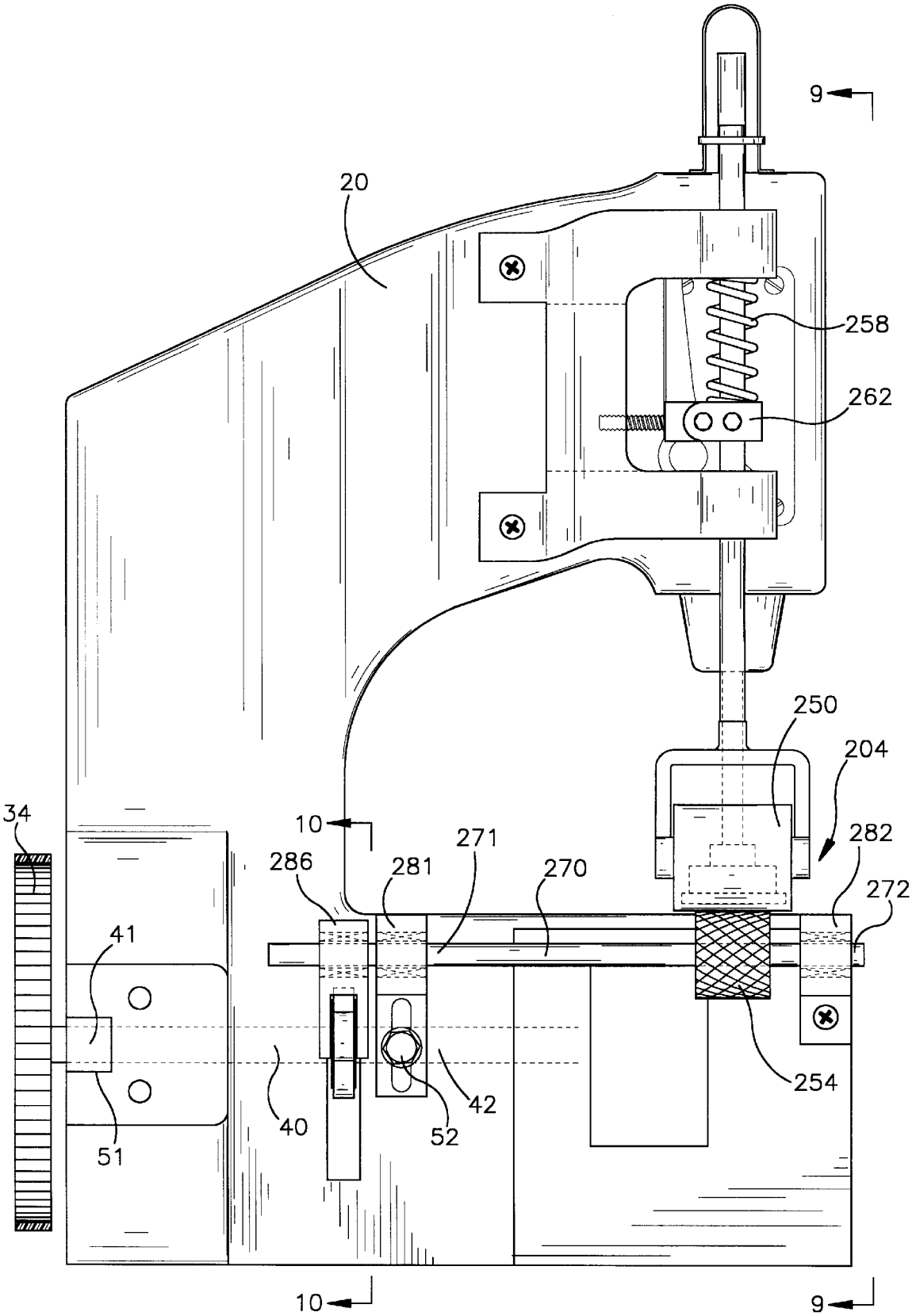
FIG. 2 is a rear side view of the portable carpet binding machine shown in FIG. 1.

Referring to FIG. 2, the housing 20 supports a drive mechanism 40. The drive mechanism 40 is supported near its front 41 and rear 42 by bushings 51, 52. The drive mechanism 40 is driven by the motor 22 via drive belt 34 and provides motive power to a sewing assembly generally designated as reference character 100, and a carpet feeding assembly generally designated as reference character 200.

The sewing assembly 100 includes a sewing needle 102 (shown in FIGS. 3A and 3B) for introducing a needle thread 103, a binder guide 104 for introducing binding material 14, and a looper 106 (shown in FIG. 4) for introducing a looper thread 107. The threads 103, 107 are supplied via a needle thread spool 122 and a looper thread spool 124, respectively (see FIG. 1). An adjustable needle thread tensioner 123 and an adjustable looper thread tensioner 125 pinch the respective threads 103, 107. The tensioners 123, 125 allow the operator of the sewing machine 10 to adjust the amount of tension, or pull, required by the machine 10 to feed the threads 103, 107 during a sewing cycle. In the preferred embodiment, the needle thread 103 comprises a monofilament plastic thread; the binding material 14 comprises flat nylon material in the form of tape; and the looper thread 107 comprises a nylon thread.

As can be seen in FIG. 1, the sewing needle 102 is connected to a reciprocating rod 108 which effects upward and downward movement of the needle 102. Reciprocal motion of the rod 108 is controlled by a lever and connecting rod assembly (not shown) driven by the drive mechanism 40. In operation, one revolution of the drive mechanism 40 effects a full upward and downward stroke, or cycle, of the sewing needle 102.

Figure 3B:
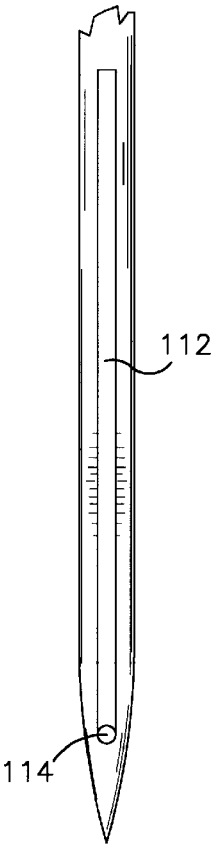
FIG. 3B is a left side view of the needle shown in FIG. 3A.
Figure 3A:
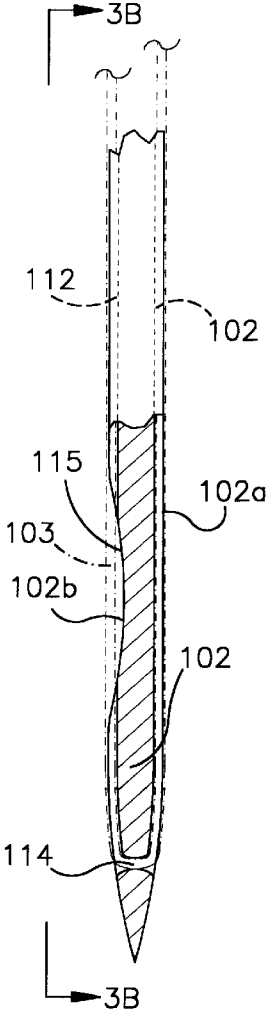
FIG. 3A is a broken view of a needle partially showing in cross-section a groove of the needle.

Referring now to FIGS. 3A and 3B, the front 102*a* and back 102*b* sides of the sewing needle 102 define a groove, or channel 112, in which the needle thread 103 is confined and guided as the needle descends and passes through the piece of carpet 12. The groove 112 extends from about where the needle 102 is connected to the reciprocating rod 108 to the tip of the needle 102. The tip of the needle 102 includes an aperture 114 into which the needle thread 103 is threaded. The back side 102*b* of the needle 102 includes a bevelled portion, or scarf 115, so that, as will be explained below, the looper 106 does not interfere with the motion of the needle 102 as the needle 102 and looper 106 are in close proximity to each other.

Figure 4:
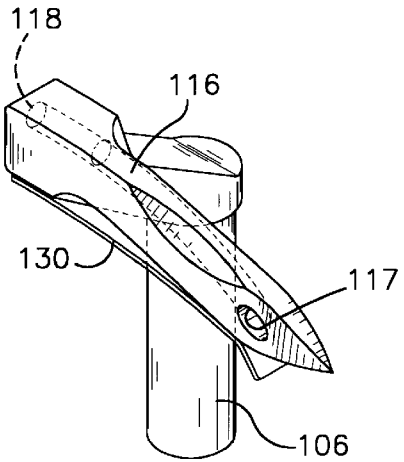
FIG. 4 is a perspective view of a looper.

FIG. 4 shows a looper 106. The looper 106 defines a groove, or channel 116, in which the looper thread 107 is confined and guided. The groove 116 extends from an aperture 117 located near the tip of the looper 106 to an aperture 118 located near the heel, or rear portion, of the looper 106.

As is generally shown in FIG. 1, the binder guide 104 operates to fold and dispense the strip of binding material 14 around the edge 11 of the piece of carpet 12. The binder guide 104 is removable and replaceable to accommodate different thickness carpet pieces.

In operation, as the carpet 12 is advanced by the carpet feeding assembly 200 (partially shown in FIG. 2), the sewing assembly 100 operates to stitch the binding material 14 simultaneously to the top 15 and bottom 16 of the piece of carpet 12 by what is known in the art as a type 401 double locked chain stitch.

Figure 5:
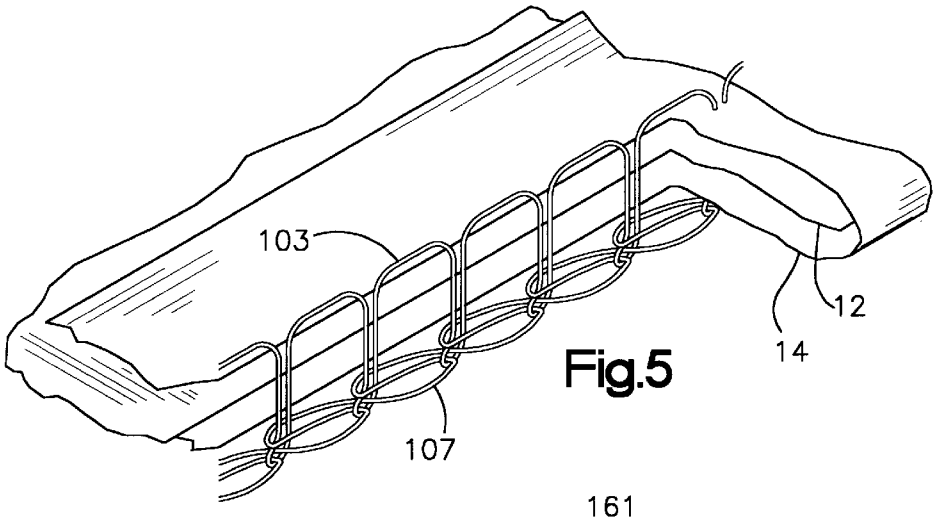
FIG. 5 is a broken perspective view showing the interloop pattern of a type 401 stitch.
Figure 6B:
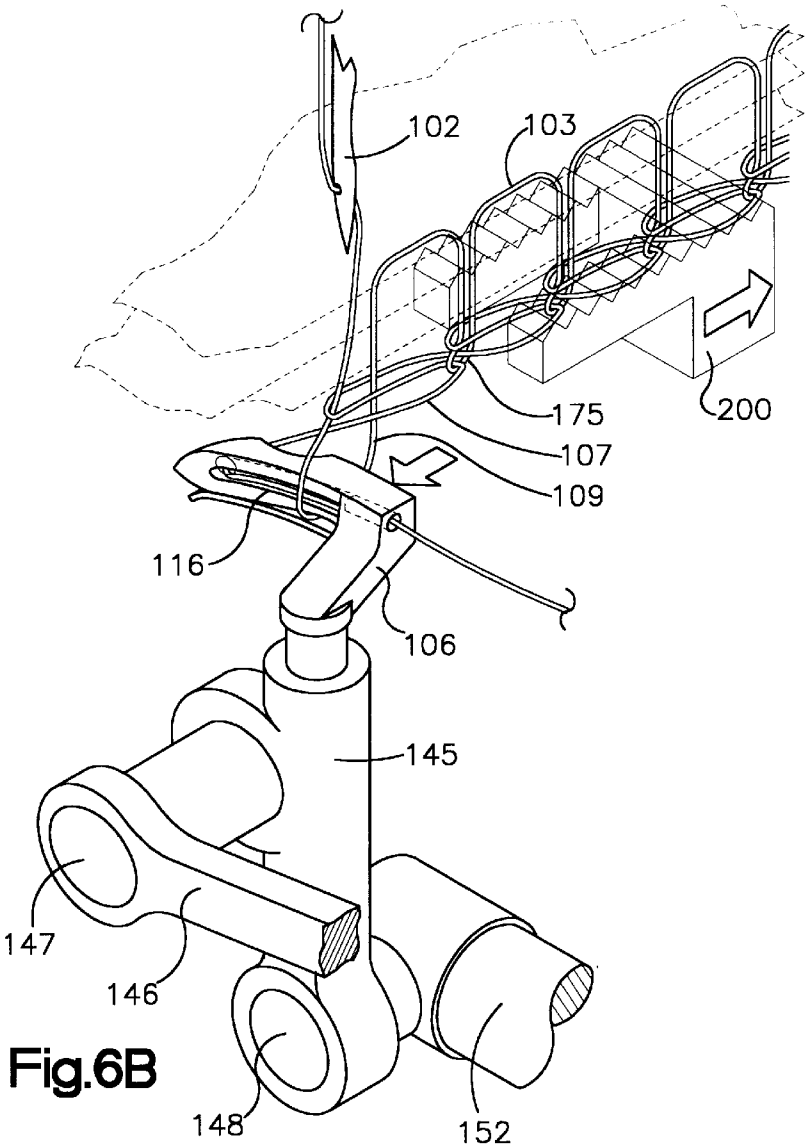
FIGS. 6A through 6D are perspective views showing the formation of a type 401 stitch.
Figure 6A:
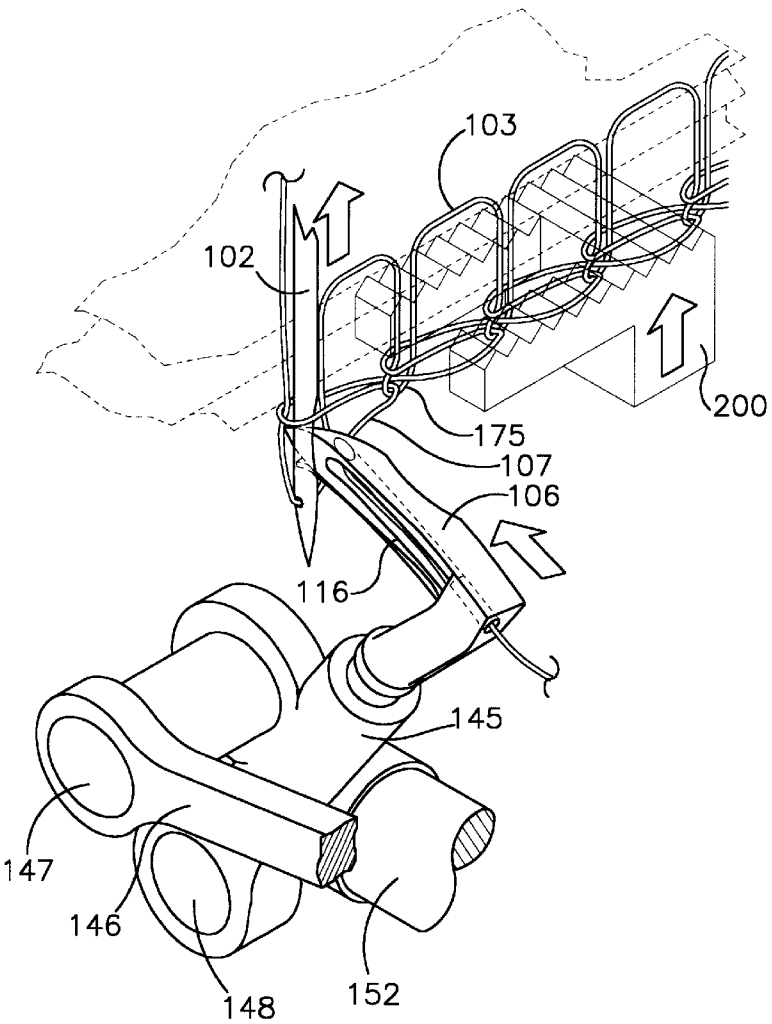

The type 401 stitch is shown in FIG. 5. To produce the type 401 stitch the needle thread 103 and looper thread 107 are interlooped according to the following process. As shown in FIG. 6A, the needle thread 103 is passed through the piece of carpet 12 by the needle 102 to below the bottom 16 of the piece of carpet 12 and then begins to ascend, leaving a loop 109 of needle thread 103 on the back side 102*b* of the needle 102 beneath the piece of carpet 12. As will be explained below, oftentimes the loop 109 is not fully formed or the loop 109 forms on the front side 102*a* of the needle 102, thus causing a skip in the stitch or other undesirable sewing problems.

While the needle 102 is ascending, the looper thread 107, guided by the looper 106 within the groove 116, advances through the loop 109 formed by the needle thread 103. A clearance is maintained between the looper 106 and needle 102 with the aid of the bevel, or scarf 115, in the back side 102*b* of the needle 102 (see FIGS. 3A and 3B). The needle 102 then ascends a predetermined distance above the piece of carpet 12 with the needle thread 103 around the looper 106. As shown in FIG. 6B, as the needle continues its ascension above the piece of carpet 12, the carpet feeding assembly 200 advances the piece of carpet 12 a predetermined distance D and the looper 106 (with the needle 102 "out of the way") rotates via a rocker motion to the front side 102*a* of the needle 102. With the needle thread 103 wrapped around the looper 106, the needle 102 begins to descend, the looper 106 begins to retract, and the carpet feeding assembly 200 disengages.

Figure 7:
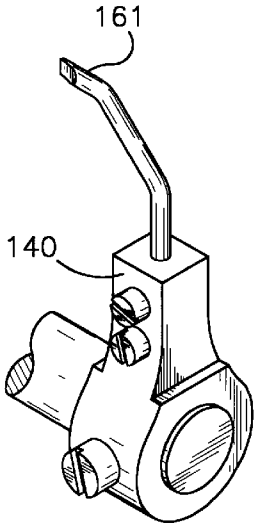
FIG. 7 is a perspective view of a loop deflector constructed in accordance with the present invention.
Figure 6D:
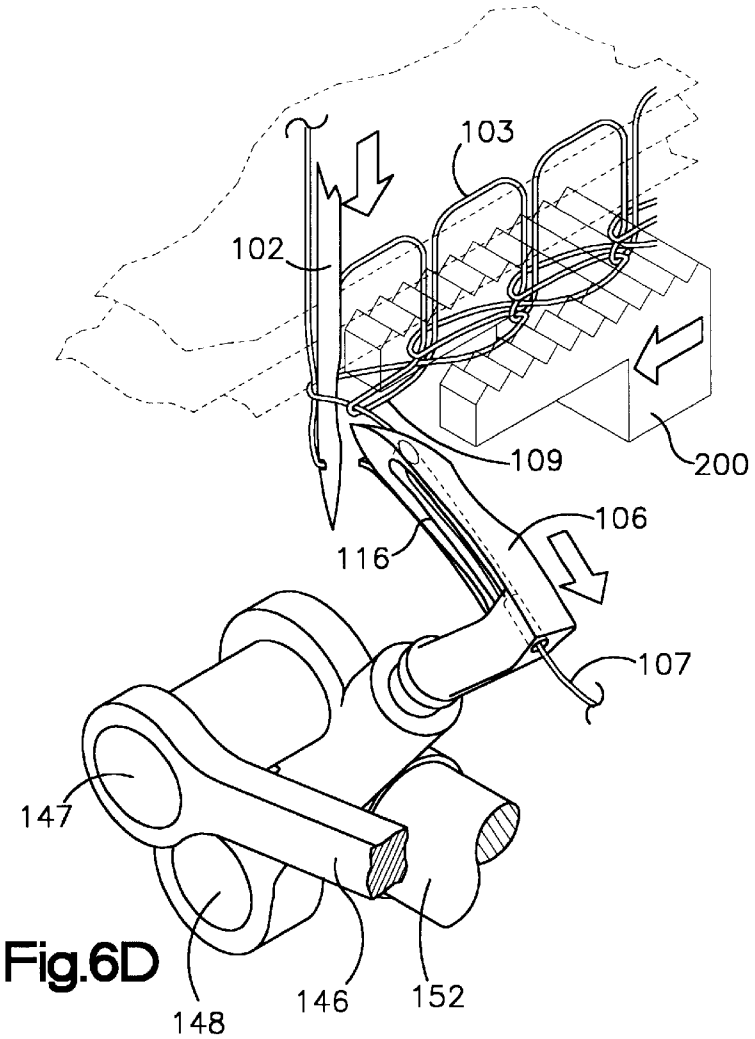
Figure 6C:
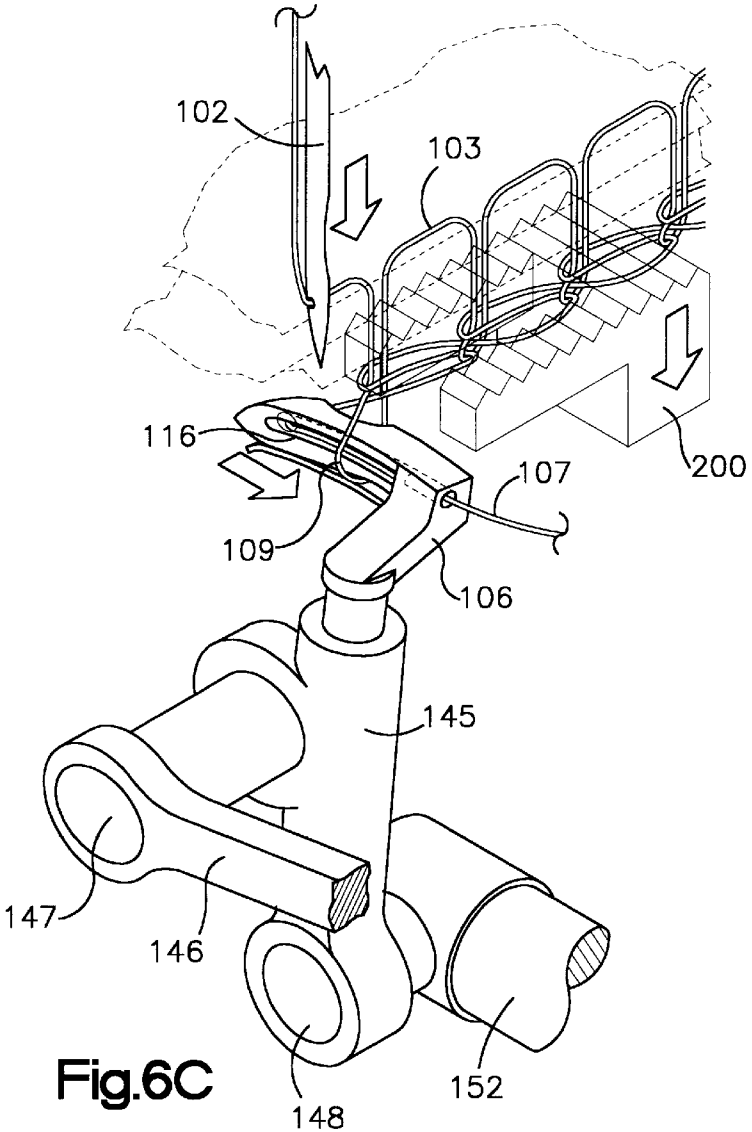

As shown in FIG. 6C, a triangle is formed having as its sides the looper 106, the looper thread 107, and the loop 109 of the needle thread 103. In accordance with the present invention a leaf spring 130 is attached to the looper 106 (see FIGS. 4 and 7) to retard movement of the loop 109 of needle thread 103 as it slides towards the tip of the looper 106. This provides an advantage over prior art type 401 chain stitch machines and, in particular, carpet binding machines since such machines are not equipped with a looper 106 having a leaf spring 130.

It has been found that when the loop 109 of the triangle is too quickly cast off a malformed stitch may occur. The leaf spring 130 ensures that the loop 109 is cast off only after the tip of the needle 102 has descended a predetermined distance below a plane defined by the three sides of the triangle. For a typical sewing cycle, it is believed that the triangle is formed and the loop 109 cast off in less than a tenth of a second. In accordance with the present invention, the leaf spring 130 provides means for adjusting the rate at which the loop 109 of needle thread 103 is cast off the looper 106. It is believed that such adjustments are capable of varying the rate on the order of milliseconds.

As the needle 102 continues its downward motion, the looper 106 continues to retract. As shown in FIG. 6D, the loop 109 formed by the needle thread 103 is then cast off the looper 106. As the needle 102 continues its downward motion it pulls the needle thread 103 taut, thereby completing a stitch. As the needle 102 begins to ascend a new loop 109 of needle thread 103 is formed on the back side 102*b* of the needle 102, thereby readying the sewing machine 10 for the next stitch.

Figures 8A, 8B, 8C:
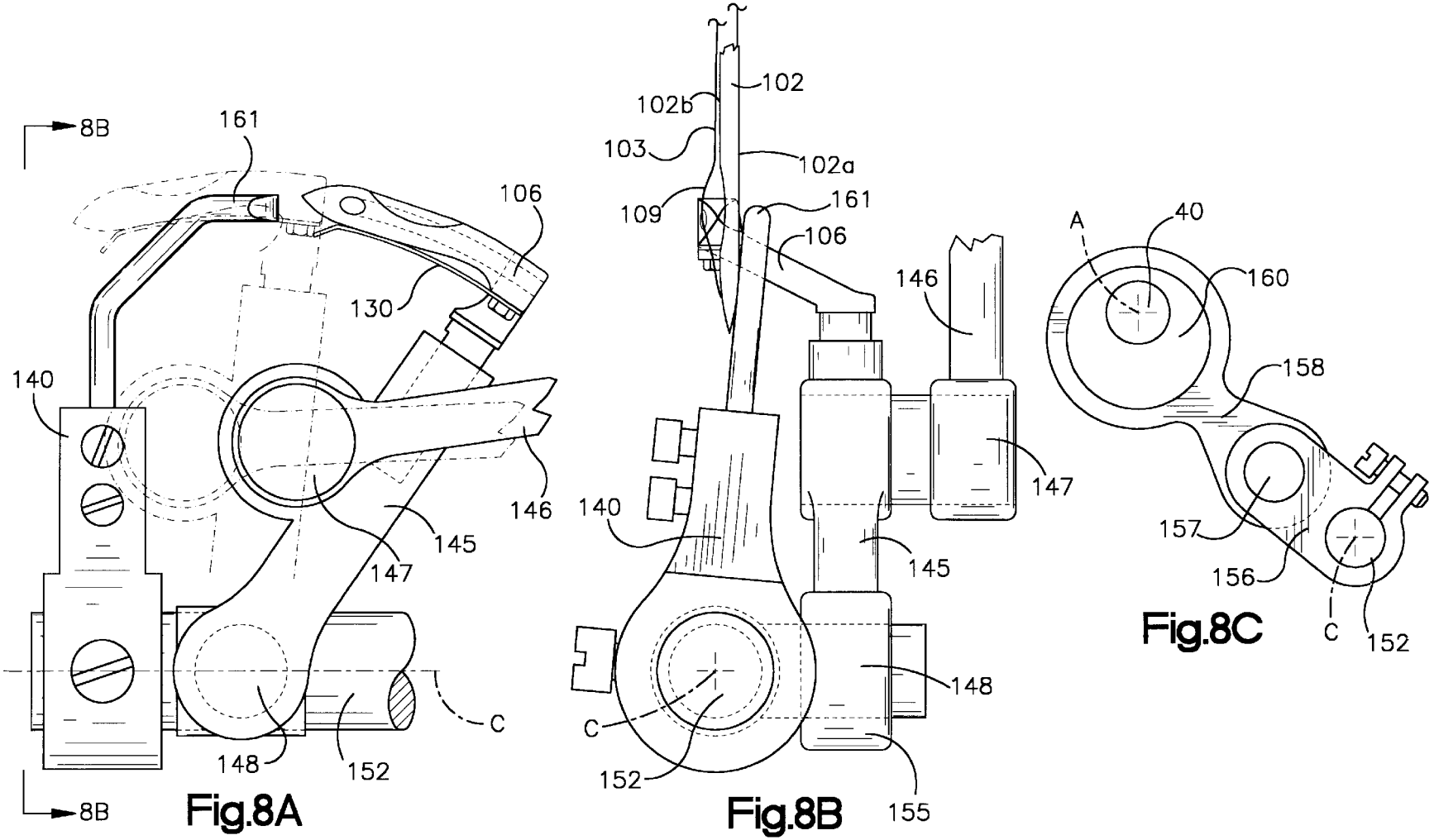
FIGS. 8A through 8C show the cooperative relationship of the looper shown in FIG. 4 and the loop deflector shown in FIG. 7.

Referring now to FIGS. 8A through 8C, there is seen a loop deflector 140 constructed in accordance with the present invention. As was indicated above, to describe the features of the present invention, the illustrated embodiment shows a Newlong Model NP-3II portable bag closing machine with modifications thereto. The Newlong machine does not include a loop deflector. The present invention modifies the Newlong machine to include such a device.

As alluded to herein above, often times in the formation of the type 401 stitch the loop 109 forms on the front side 102*a* of the needle 102 rather than the back side 102*b*. This is more likely to occur in machines utilizing a needle thread made of a monofilament plastic material because such a thread has an unpredictable tendency to flex or bow. It has been found that for about every 75 to 100 stitches, about 5 to 10 are skipped due to unpredictable flexure of the needle thread 103.

According to the present invention, the loop deflector 140 assists in forming the loop 109 on the back side 102*b* of the needle 102 by pushing the needle thread 103 from the front side 102*a* through the aperture 114 and extending away from the back side 102*b* of the needle 102 as the needle 102 makes its ascension to form the loop 109. The loop deflector 140 operates in a rocker motion while the looper 106 simultaneously operates in two separate motions, a rocker motion in unison with the loop deflector 140 and an advance-retraction motion independent of the movement of the loop deflector 140.

Figure 11:
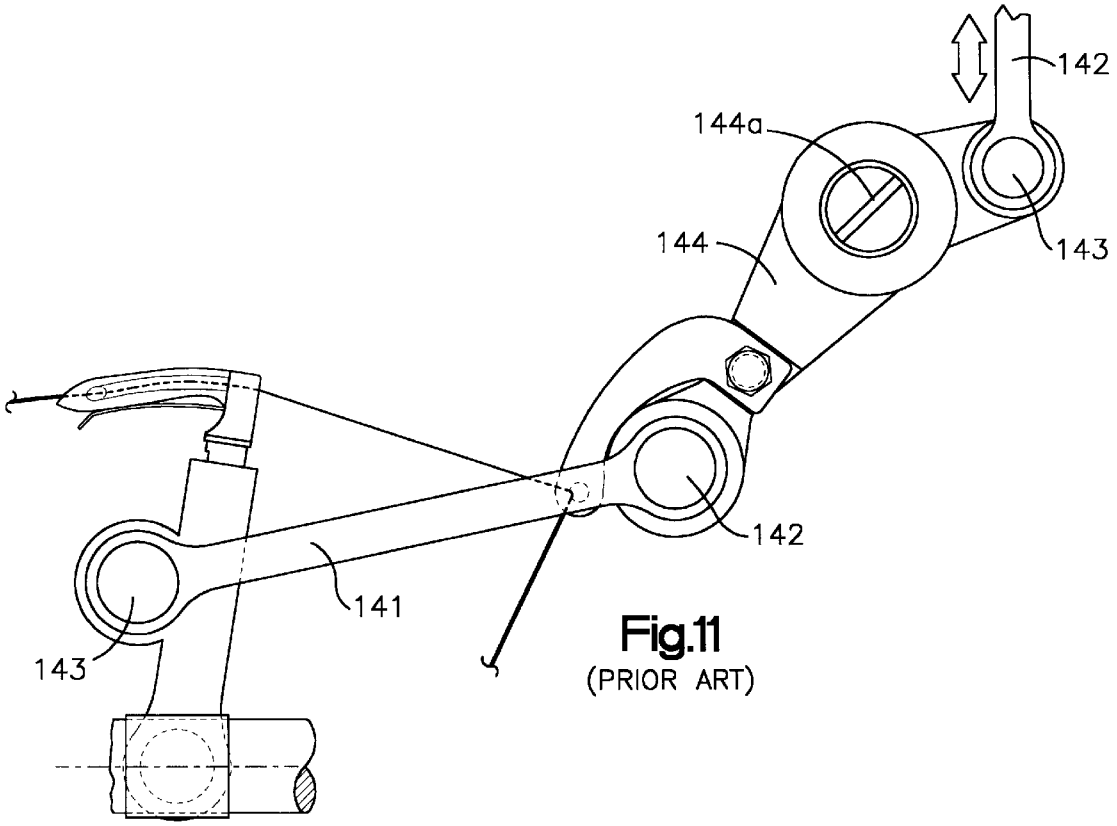
Fig.11 (PRIOR ART)
FIG. 11 is a plan view of a prior art looper thread take-up apparatus.

As is generally shown in FIGS. 11 and 12, the advance-retraction motion of the looper 106 is generated by the drive mechanism 40 via a pair of connecting rods 141, 142 having ball joint assemblies 143 at their ends 143, and a bell crank 144 therebetween pivotally connected to a bell crank hinge stud 144*a*. Upward and downward movement of connecting rod 142 is controlled by the drive mechanism 40. As shown in FIGS. 8A and 8B, the looper 106 is connected to a looper retractor member 145. A rod 146 is rotatably connected to the looper retractor member 145 at pin 147 for advancing (to the left in FIG. 8A) and retracting (to the right in FIG. 8A) the looper 106 relative to pin 148. During a typical sewing cycle, one revolution of the drive mechanism 40 effects a full upward and downward stroke, or cycle, of the connecting rod 142 and, accordingly, a full advancement and retraction motion, or one complete advance-retraction cycle, of the looper 106.

The rocker motion of the loop deflector 140 and the looper 106 is effected by a cam and rocker assembly powered by the drive mechanism 40. As shown in FIGS. 8A and 8B, the loop deflector 140 is fixedly attached to a rocker shaft 152. A looper rocker frame 154 is fixedly attached to the rocker shaft 152 and provides rocker motion to the looper 106 via the looper retractor member 145. The looper rocker frame 154 also provides a bearing surface 155 adjacent to the looper retractor member 145. As FIG. 8B indicates, the loop deflector 140 and the looper 106 pivot, or rock, in unison about axis C of the rocker shaft 152.

Referring now to FIG. 8C, it is seen that a rocker arm 156 is connected to the rocker shaft 152. A link pin 157 pivotally connects the rocker arm 156 relative to a looper avoid link 158, so named because it moves the looper 106 when the needle 102 is in its upward position, thereby avoiding interference with the stroke of the needle 102. The looper avoid link 158 is rotatably connected to an eccentric cam 160 fixedly attached to the drive mechanism 40.

In operation, as the drive mechanism 40 rotates, the cam 160 drives the rocker arm 156 downward and upward which, in turn, rotates the rocker shaft 152 counterclockwise and clockwise, respectively, a predetermined angle. Accordingly, the loop deflector 140 and the looper 106 also rotate, or rock, the predetermined angle. During a typical sewing cycle, one revolution of the drive mechanism 40 effects a full backward rocking motion and a full forward rocking motion, or one complete rocker cycle, of the looper 106.

The loop deflector 140 includes a stem portion 161. It should be noted, as viewed in FIGS. 8A and 8B, that the gap, or angular displacement, between the stem portion 161 of the loop deflector 140 and the looper 106 does not change.

FIG. 8B shows the loop deflector 140, the looper 106, and the needle 102 in cooperative relationship as the looper 106 advances through the loop 109 formed by the needle thread 103. In particular, as the needle 102 moves upward, the loop deflector 140 is immediately in front of (or to the right of, in FIG. 8B) and in relatively close proximity to the front side 102*a* of the needle 102. Thus, the needle thread 103 is blocked, or deflected, from passing to the front side 102*a* of the needle 102. The looper 106, meanwhile, which has already rotated, or rocked, to a position behind the needle 102, advances towards the loop 109 via leftward movement, as shown in FIG. 8A (out of the plane of the paper in FIG. 8B), of the looper retractor member 145 and the connecting rod 146.

The loop deflector 140 provides several advantages over conventional sewing machines and, in particular, over conventional carpet binding machines. It is believed that the loop deflector 140 can substantially inhibit the occurrence of skipped stitches due to flex in the needle thread 103. This is advantageous for any sewing machine, whether for closing bags, sewing fabric or binding carpet, that produces the type 401 stitch. It is particularly advantageous for carpet binding machines, whether stationary or portable, such as herein described, because such machines typically utilize a monofilament plastic thread that is more susceptible to unpredictable flexure than some other types of thread.

Figures 12A, 12B, 12C:
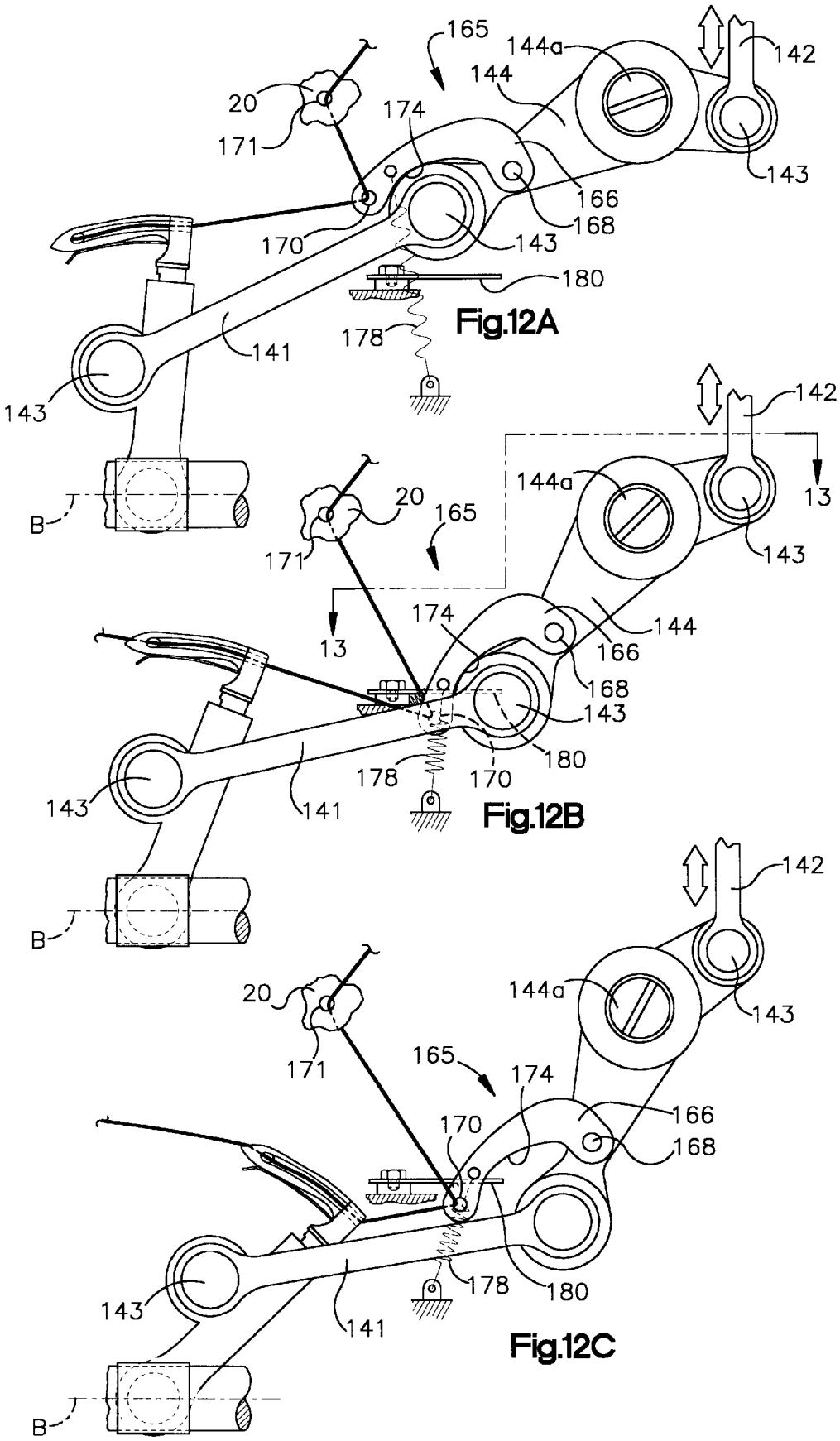
FIGS. 12A through 12C are plan views of a looper thread take-up apparatus constructed in accordance with the present invention and showing the position of the take-up apparatus during different sewing operations.

Referring now to FIGS. 12A through 12C, there is seen a modified looper thread take-up apparatus constructed in accordance with the present invention, generally indicated as reference character 165. The type 401 stitch described herein above requires that slack or tension be provided in the looper thread 107 during the sewing cycle. The looper thread take-up apparatus 165 performs this function.

As was indicated above, to describe the features of the present invention, the illustrated embodiment shows a Newlong Model NP-3II portable bag closing machine with modifications thereto. A looper thread take-up apparatus of the Newlong machine is shown in FIG. 11. Such an apparatus is particularly applicable to and well-suited for bag closing machines. The present invention modifies the looper thread take-up of the Newlong machine to enable it to provide the slack and take-up in the looper thread 107 that is necessary for the particular requirements of the portable carpet binding machine 10 of the present invention as herein described.

In accordance with the present invention, the looper thread take-up apparatus 165 includes a thread take-up 166 pivotally connected to the bell crank 144 via a pivot pin 168. The thread take-up 166 includes an aperture 170 through which the looper thread 107 is threaded. The looper thread 107 is routed through an aperture 171 in the housing 20 and to the looper thread tensioner 125 and looper thread spool 124.

Figure 13:
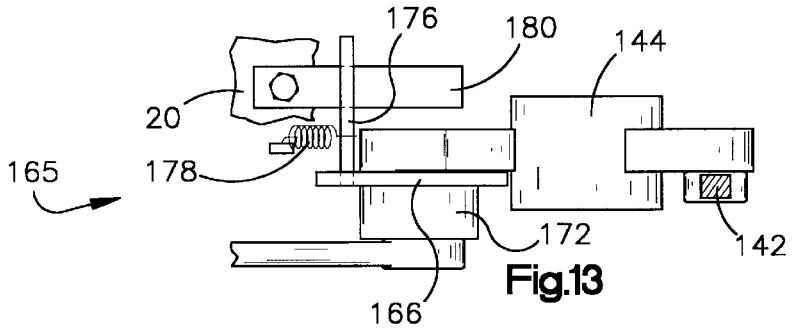
FIG. 13 is a plan view of the looper thread take-up apparatus shown in FIGS. 12A through 12C as viewed from the plane 13—13 shown in FIG. 12B.

The bell crank 144 includes a boss 172 that, as shown in FIG. 12A, contacts the underside 174 of the thread take-up 166 as the bell crank 144 turns clockwise a predetermined angle about the bell crank hinge stud 144*a*. After the boss 172 contacts the thread take-up 166, further clockwise rotation of the bell crank 144 raises the thread take-up 166 in unison with the bell crank 144. As shown in FIG. 13, the thread take-up 166 includes a cast-off contact bar 176 projecting outwardly from the thread take-up 166. A pull spring 178 is connected to the contact bar 176 at one end and to an inside wall of the housing 20 at its other end. The pull spring 178 biases the thread take-up 166 in a counterclockwise direction. A stop member 180 attached to an inside wall of the housing 20 is positioned relative to the thread take-up 166 so that the contact bar 176 comes into contact with the stop member 180 as the thread take-up 166 moves downward. After the contact bar 176 contacts the stop member 180, further counterclockwise rotation of the bell crank 144 momentarily pulls the thread take-up 166 to the right and causes the contact bar 176 to move to the right along the top of the stop member 180, as viewed in FIG. 12A. Upon resuming its clockwise motion, the bell crank 144 momentarily pushes the thread take-up 166 to the left and causes the contact bar 176 to move to the left along the top of the stop member 180. As the bell crank 144 rotates further clockwise, the boss 172 of the bell crank 144 contacts the underside 174 of the thread take-up 166, thereby readying the sewing assembly 100 for the next sewing cycle.

The operation of the thread take-up apparatus 165 is best understood with reference to the formation of the type 401 stitch as described hereinabove and shown in FIGS. 6A through 6D. Referring to FIG. 6A, it is seen that a loop 175 of needle thread 103 from the previous stitch remains to be pulled snug to the bottom 16 of the piece of carpet 12. Thus, if the looper thread 107 was pulled taut it would tend to pull the needle thread 103 away from the carpet 12. In FIG. 6A, the looper thread take-up apparatus 165 provides slack in the looper thread 107 to prevent such resistance in the needle thread 103. To do so, the thread take-up apparatus 165, during its previous downward motion, drew a predetermined amount of looper thread 107 through the looper thread tensioner 125 and from the looper thread spool 124 to provide the necessary amount of looper thread 107 for the upcoming stitch to be made as shown in FIGS. 6A through 6D.

Referring to FIG. 6B, the loop 175 of needle thread 103 from the previous stitch has been pulled snug to the bottom 16 of the piece of carpet 12 and the looper 106 has advanced through the new loop 109 formed by the needle thread 103. Meanwhile, as shown in FIG. 12A, the looper thread take-up 166 moves upward to provide slack in the looper thread 107. The slack is generated by shortening the path of the looper thread 107 between the looper thread tensioner 125 and the looper 106 while maintaining the same amount of thread 107 that was drawn by the thread take-up 166 from the spool 124 after the previous stitch. During a sewing cycle, substantially all of the slack in the looper thread 107 is taken up by backward movement of the piece of carpet 12 by the carpet feeding assembly 200 (see FIG. 6B).

As FIG. 12A indicates, when the thread take-up 166 reaches its maximum height it does not provide any more slack in the looper thread 107. Any slack remaining in the looper thread at this point is from the slack which was not taken up by the backward movement of the piece of carpet 12 by the carpet feeding assembly 200. As the thread take-up 166 is moved downward it lengthens the path between the looper thread tensioner 125 and the looper 106 and, therefore, removes the remaining slack in the looper thread 107. This aids in forming the triangle since, as shown in FIG. 6C, the formation of a proper triangle depends, in part, on a straight and taut looper thread 107. As the thread take-up 166 continues its downward motion it removes all the slack in the looper thread 107. Once all the slack is removed, the thread take-up 166 pulls looper thread 107 through the looper thread tensioner 125 for the next stitch. This occurs as the needle 102 is approaching and entering the triangle, as shown in FIG. 6C. The thread take-up 166 then draws the required amount of looper thread 107 necessary for the next stitch.

As the thread take-up 166 continues its downward movement, the cast-off contact bar 176 of the thread take-up 166 contacts the stop member 180, thereby preventing any further downward movement of the thread take-up 166. The boss 177 of the bell crank 144 then falls below the underside 174 of the thread take-up 166 and the thread take-up 166 urges rightward as viewed in FIG. 12B. The rightward movement of the thread take-up 166 is in substantial unison with the retracting, or rightward, movement of the looper 106 as described hereinabove, and as generally shown in FIG. 6D. It is at this point that the loop 109 formed by the needle thread 103 is cast off the looper 106. Moreover, when the thread take-up 166 and the looper 106 move in unison, the length of the path between the looper thread tensioner 125 and the looper 106 remains relatively constant and, consequently, there is substantially no pull on the looper thread 107. This is important because it prevents additional pull on the looper thread 107 which can cause an overextended amount of slack in the looper thread 107 for the next stitch.

When the thread take-up 166 reaches its far right position, shown in FIG. 12C, the thread take-up 166 remains substantially idle for a period of time during which the looper 106 makes its looper avoid motion as described hereinabove; that is, while the looper 106 rocks from a position in front of the needle 102 to a position behind the needle 102, the thread take-up 166 remains substantially idle. After the looper 106 makes it looper avoid motion, the thread take-up 166 moves leftward, as viewed in FIG. 12A. The leftward movement of the thread take-up 166 is in substantial unison with the advancing, or leftward, movement of the looper 106 as described hereinabove, and as generally shown in FIG. 6A. When the thread take-tip 166 and the looper 106 move in unison, the length of the path between the looper thread tensioner 125 and the looper 106 remains relatively constant and, consequently, there is substantially no pull on the looper thread 107. Again, this is important to prevent an overextended amount of slack in the looper thread 107 for the next stitch.

When the thread take-up 166 reaches its far left position, as shown in FIG. 12A, the boss 172 of the bell crank 144 contacts the underside 174 of the thread take-up 166. Further clockwise movement of the bell crank 144 forces the thread take-up 166 upward which, in turn, shortens the distance between the looper 106 and the thread take-up 166 and, therefore, provides slack in the looper thread 107 in preparation for the next sewing cycle.

Referring again now to FIG. 1, there is seen a strike-off wire 184. The type 401 stitch described herein above requires that slack or tension be provided in the needle thread 103 during the sewing cycle. A needle thread take-up 186 performs this function. As was indicated above, to describe the features of the present invention, the illustrated embodiment shows a Newlong Model NP-3II portable bag closing machine with modifications thereto. The needle thread take-up 186 without the strike-off wire 184 is well-suited for providing the required slack or tension in the needle thread 103 for bag closing applications. The Newlong machine does not include a strike-off wire 184. The present invention modifies the Newlong machine by incorporating a strike-off wire 184 to enable it to provide slack in the needle thread 103 that is necessary for the particular requirements of the portable carpet binding machine 10 of the present invention as herein described.

The needle thread take-up 186 is connected to the reciprocating rod 108 and moves upward and downward in unison with the rod 108. Slack is generated by shortening the path of the needle thread 103 between the needle thread tensioner 123 and the needle 102 while maintaining the same amount of thread 103 that was drawn by the thread take-up 186 from the spool 122 after the previous stitch. Slack is necessary to form the loop 109 on the front side 102*a* of the needle 102.

The strike-off wire 184 enables the portable carpet binding machine 10 of the present invention to bind different carpet thicknesses. An increased thickness piece of carpet 12 requires a larger-sized loop 109 of needle thread 103 to complete a stitch. As can be seen in FIG. 1, the lower portion of the strike-off wire 184 includes an upwardly turned hook 188. As the needle thread take-up 186 moves downward, the needle thread 102 is pulled downward beyond the hook 188. This lengthens the path between the needle thread tensioner 123 and the needle 102 and, consequently, pulls an additional amount of needle thread 103 from the spool 122 than would otherwise be pulled without the strike-off wire 184.

The height of the strike-off wire 184 is adjustable, thereby allowing adjustments in the amount of slack in the needle thread 103 and, consequently, the size of the loop 109 of the needle thread 103. For a heavy pile, the strike-off wire 184 is moved upward to provide additional slack in the needle thread 103 and, for a light pile, the strike-off wire 184 is moved downward to reduce the slack.

Figure 9:
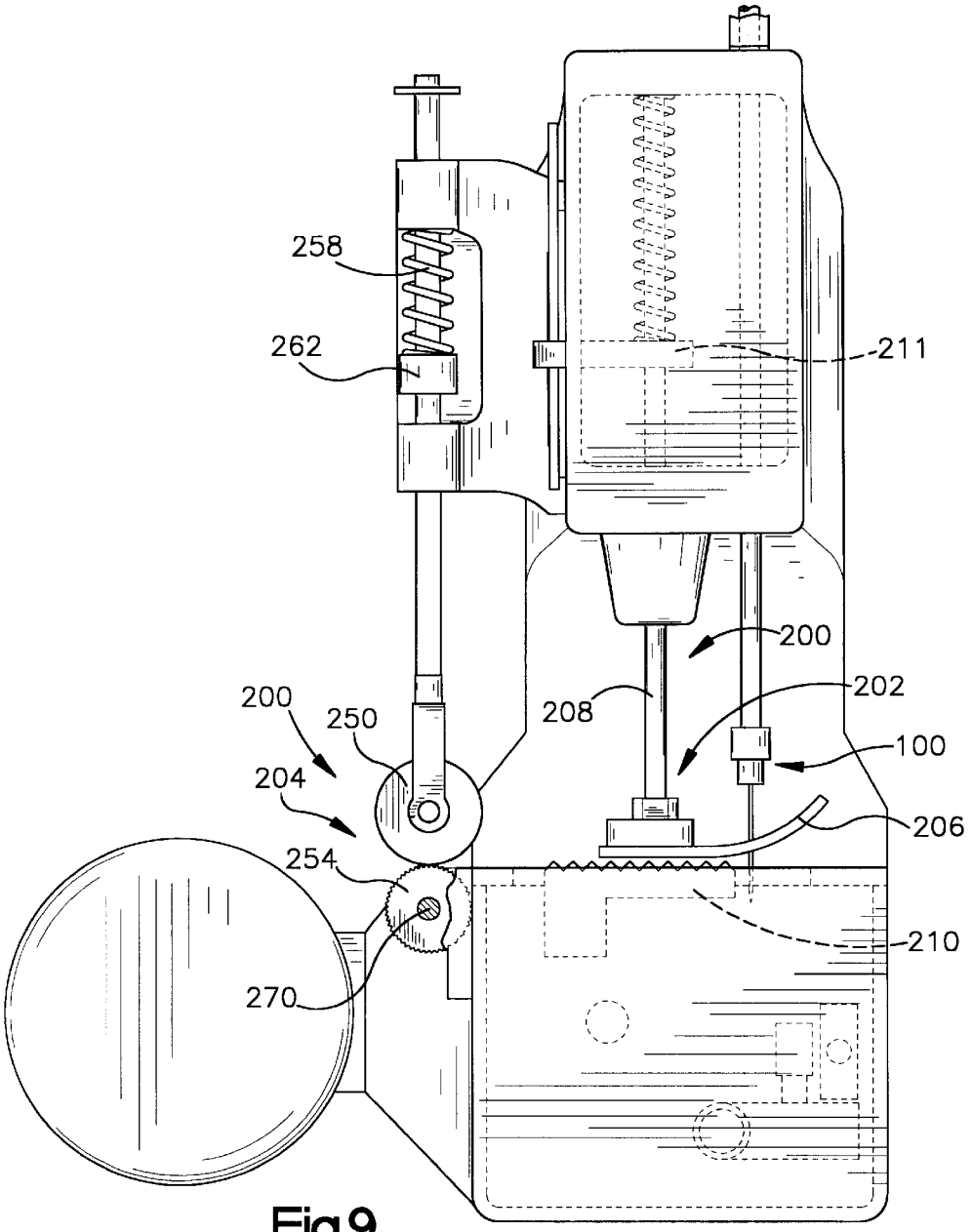
FIG. 9 is a left side view of the portable carpet binding machine shown in FIG. 1 as viewed from the plane 9—9 in FIG. 2.
Figure 10:
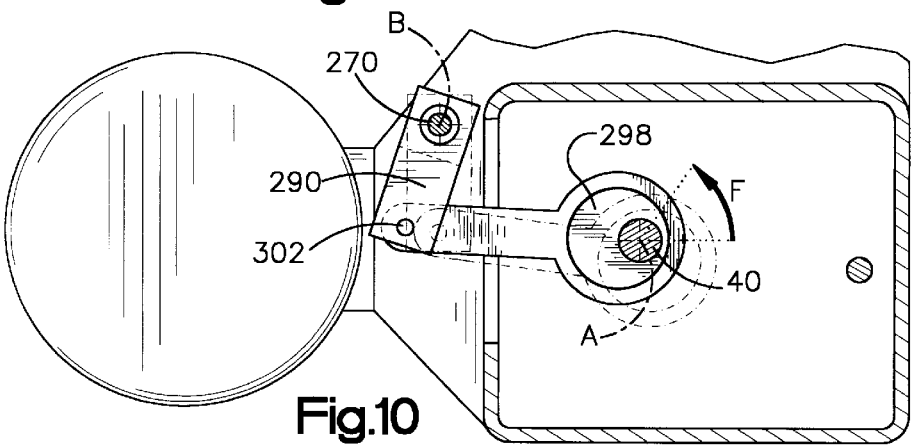
FIG. 10 is a broken left side view of the portable carpet binding machine shown in FIG. 1 showing the lower portion of the machine as viewed from the plane 10—10 in FIG. 2.

Referring now to FIG. 2, and more particularly to FIGS. 9 and 10, there is seen a carpet feeding assembly, generally indicated as reference character 200, that features a dual feed capability. The carpet feeding assembly 200 includes a feed driver mechanism, generally indicated as reference character 202 and a coacting puller mechanism, generally indicated as reference character 204, which operate in synchronized movement to feed the piece of carpet 12 relative to the sewing assembly 100.

The feed driver mechanism 202 includes a presser foot 206, a presser bar 208, and a feed-dog 210. The presser foot 206 prevents the piece of carpet 12 from moving upward when the needle 102 ascends through the piece of carpet 12 or, as will be described below, upward movement of the feed-dog 210 located below the presser foot 206. A predetermined amount of downward force is maintained by the presser foot 206 via spring 211. A presser foot adjusting mechanism 212 maintains the presser foot 206 at a predetermined height.

As is known in the art, the feed-dog 210 operates to engage the bottom 16 of the piece of carpet 12 via a rocker and cam assembly (not shown) connected to the drive mechanism 40. The rocker and cam assembly simultaneously control the forward and backward movement and the rise and fall of the feed-dog 210. As shown in FIG. 6B, between stitches the rocker and cam assembly operate to raise the feed-dog 210 so that it engages the bottom 16 of the piece of carpet 12 and then push the feed-dog 210 forward which, in turn, advances the piece of carpet 12 forward a distance D. During stitching, the rocker and cam assembly make the feed-dog 210 descend, move backward, then rise again. Thus, the feed-dog 210 disengages the piece of carpet 12 shortly before the needle 102 penetrates the piece of carpet 12 to initiate a stitch. And likewise, the feed-dog 210 engages the piece of carpet 12 shortly after the needle 102 ascends above the top 15 of the piece of carpet 12 and has completed a stitch.

FIGS. 2, 9 and 10 show the coacting puller mechanism 204. The coacting puller mechanism 204 includes a top-mounted presser roller 250 and a bottom-mounted feed roller 254. A spring 258 maintains a predetermined amount of downward force in the presser roller 250 opposite the feed roller 254 so that the piece of carpet 12 is engaged therebetween. The piece of carpet 12 is fed by rotation of the feed roller 254. The feed roller 254 engages the bottom 16 of the piece of the carpet 12 and pulls the piece of carpet 12 relative to the sewing assembly 100. A presser roller adjusting mechanism 262 maintains the presser roller 250 at a predetermined height.

Referring more closely now to FIG. 2, the feed roller 254 is fixedly attached to a rocker shaft 270 that is supported near its front 271 and rear 272 by bushings 281, 282, respectively. The feed roller 254 is intermittently rotated by a clutch 286 which, when viewed in FIG. 10, engages the rocker shaft 270 when turned counterclockwise and disengages the rocker shaft 270 when turned clockwise. The clutch 286 is fixedly engaged by a rocker arm 290 that translates intermittent clockwise and counterclockwise rotation to the clutch 286 by means of a puller link 294 and an eccentric cam 298 fixedly attached to the drive mechanism 40. A link pin 302 pivotally connects the rocker arm 290 relative to the puller link 294. The puller link 294 is rotatably connected to the eccentric cam 298.

As shown in FIG. 10, as the eccentric cam 298 rotates in a forward counterclockwise motion about axis A of the drive mechanism 40, indicated by arrow F in FIG. 10, the puller link 294 effects a forward and backward stroke of the rocker arm 290. As the rocker arm 290 makes a forward stroke (clockwise about the axis B of the rocker shaft 270 in FIG. 10), the clutch 286 is turned clockwise and thus is disengaged from the rocker shaft 270. Consequently, the rocker shaft 270 remains idle as does the feed roller 254. As the rocker arm 290 makes its backward stroke (counterclockwise about the axis B of the rocker shaft 270 in FIG. 10), the clutch 286 turns counterclockwise and thus engages and rotates the rocker shaft 270 a predetermined angle alpha which, in turn, rotates the feed roller 254 an angle alpha. As the feed roller 254 rotates, the piece of carpet 12 between the feed roller 254 and presser roller 250 advances a corresponding length D (see FIG. 6B).

Referring now to FIGS. 9 and 10, for each one revolution of the drive mechanism 40, the feed roller 254 of the coacting puller mechanism 204 operates in synchronous movement with the feed-dog 210 of the feed driver mechanism 202 to engage the bottom 16 of the piece of carpet 12 and feed the piece of carpet 12 the length D as seen in FIG. 6B. To accomplish this synchronized movement, components such as levers, rockers, links and cams must be designed so that the rotation of the feed roller 254 is timed simultaneously with the forward movement of the feed-dog 210. For example, a modification of the diameter of the eccentric cam 298 or the length of the rocker arm 270 results in a change in the stroke of the rocker arm 290 and, consequently, the amount of rotation in the rocker shaft 270 and feed roller 254. According to the present invention, the components are sized and timed so that during a stitch the feed-dog 210 is disengaged from the carpet 12 and the feed roller 254 is idle and so that between stitches both the feed-dog 210 and the feed roller 254 engage the piece of carpet 12 from its bottom 16 and advance it a distance D relative to the sewing assembly 100.

The coacting puller mechanism 204 of the present invention is advantageous over puller mechanisms of conventional dual feed portable carpet binding machines. Unlike other portable carpet binding machines, the coacting puller mechanism 204 of the present invention provides a bottom-driven feed roller 254. The top portion, or pile, of any type of carpet has an unpredictable tendency to flex, or shift, as pressure is applied to it. Thus, top mounted feed rollers do not adequately engage the carpet and, consequently, feeding the carpet from the top can cause the top-mounted feed roller to slip. Any slip in a top mounted feed roller can cause the feed roller to fall out of synch with the feed-dog or other carpet pulling mechanism relative to the carpet sewing assembly. This may cause the carpet to "bunch up" between the front and rear puller mechanisms causing a skipped or malformed stitch or, unless the rear puller mechanism "catches up" to the front puller mechanism, a series of skipped or malformed stitches.

The coacting puller mechanism 204 of the present invention feeds the piece of carpet 12 from its bottom surface 16, or the carpet backing. Unlike the top 15 of a piece of carpet 12, the bottom 16 is made of a relatively flat material having an abrasive surface. Thus, as the presser roller 250 applies pressure to the top 15 of the carpet 12, the feed roller 254 of the coacting puller mechanism 204 positively engages the bottom 16 of the piece of carpet 12. It is believed that this positive engagement improves carpet feed capabilities over other portable carpet binding machines.

It has been found that the carpet feeding assembly 200 can feed a piece of carpet 12 of substantially any type thickness, whether a light or heavy pile, and any type backing. The coacting puller mechanism 204, with its simultaneous movement with the feed driver mechanism 202, facilitates a no-slip linear movement of the carpet piece 12 relative to the sewing assembly 100. Moreover, because the feed driver mechanism 202 and the coacting puller mechanism 204 are driven by the same drive mechanism 40, the likelihood that the mechanisms will fall out of synch is substantially reduced.

Another advantage of the present invention is that, unlike other portable carpet binding machines, which are usually constructed of a modified sewing machine ranging in weight from 24 lbs to 31 lbs, the portable carpet binding machine of the present invention weighs about 18 lbs. The relatively lightweight construction of the present invention results from modification of a portable bag closing machine (in the illustrated embodiment, the modification of a Newlong Model NP-3II portable bag closing machine) having fewer and smaller components than other types of sewing machines. Such a lightweight construction improves portability.

Another advantage of the present invention over conventional portable carpet binding machines, is the present invention's simple construction. Many of the components are readily-available, standard off-the-shelf parts. Thus, repair and replacement of parts is simplified. The structure of the Newlong machine is particularly facilitative of the modifications in accordance with the present invention, although it should be understood by those skilled in the art that such modifications can be made to any existing portable sewing machine and, more particularly, to existing portable bag closing machines. As such, manufacturing costs of the portable carpet binding machine 10 constructed in accordance with the present invention are relatively low when compared to the modifications that would be necessary to other portable sewing machines. For example, the coacting puller mechanism 204 is driven by an eccentric cam added to the existing drive mechanism 40 of the Newlong machine. This is the only mechanically moving part of the Newlong machine that requires modification to incorporate the coacting puller mechanism 204; no other parts need be modified or relocated.

It is also believed that, because there are so few additional components that make up the coacting puller mechanism 204, the mechanism is more durable and reliable than conventional dual feed portable carpet binding machines.

Referring now again to FIG. 1, there is seen a potentiometer, or rheostat 310, for providing variable resistance and, consequently, variable speed to the motor 22. The ability to vary the speed of the motor 22 allows an operator to vary the speed of the sewing cycle in the event the needle 102 or other components of a bag closing machine or portable carpet binding machine experience excessive amounts of heat.

A typical problem with bag closing and carpet binding is the rise in temperature of the needle 102 as it passes upward and downward through the material to be stitched. In particular, in a carpet binding application, the needle 102 passes through backing material of the piece of carpet 12. The heat in the needle can cause the backing material to melt and, in some instances, clog the aperture 114 or groove 112 of the needle 102 as a result thereof. Attempts to alleviate an overheated needle have been unsatisfactory. For instance, in high speed applications some installers will purchase and use a separate compressor to blow air on the needle 102. This raises the cost of completing a sewing operation and causes inconvenience to the installer by having to carry an extra apparatus.

The potentiometer 310 incorporated into the bag closing machine in accordance with the present invention, is operable to vary the speed of the motor 22 which, in turn, varies the speed of the sewing cycle. Thus, in high speed sewing operations or in operations where the material to be stitched is of a type that does not readily expel heat, an installer can slow down the sewing process to prevent overheating in the needle 102. In less rigorous sewing operations or in cases where the material to be stitched generates less heat, the operator can increase the speed of the motor 22.

Although the present invention has been described with a certain degree of particularity, it should be understood that those skilled in the art can make various changes to it without departing from the spirit or scope of the invention as hereinafter claimed.

I claim:

1. A portable carpet binding machine comprising:

a) a housing defining an interior region;

b) a drive mechanism supported by the housing and at least partially disposed in the interior region;

c) a prime mover operatively coupled to the drive mechanism for providing motive power to the drive mechanism;

d) a sewing assembly driven via the drive mechanism for sewing a strip of material to a piece of carpet, the sewing assembly including a binder guide, a sewing needle and a looper; the binder guide operating to fold the strip of material around an edge portion of the piece of carpet, a first piece of thread being threaded through an aperture of the needle and a second piece of thread being threaded through an aperture of the looper, the sewing assembly when driven operating to stitch the strip of material to opposite sides of the edge portion of the piece of carpet using the first and second pieces of thread; and e) a carpet feeding assembly including a feed driver mechanism and a coacting puller mechanism operating in substantially synchronous movement to linearly feed the piece of carpet relative to the sewing assembly; the feed driver mechanism including a feed-dog driven via the drive mechanism that intermittently engages the bottom of the piece of carpet to thereby advance the piece of carpet forward; the coacting puller mechanism including a feed roller driven via the drive mechanism that intermittently engages the bottom of the piece of carpet to thereby pull the piece of carpet forward substantially simultaneously with respect to the advancement by the feed-dog of the feed driver mechanism.

2. The portable carpet binding machine of claim 1 wherein the coacting puller mechanism further includes a presser roller for providing a predetermined amount of downward force opposite the feed roller so that the piece of carpet is engaged therebetween.

3. The portable carpet binding machine of claim 2 wherein the coacting puller mechanism includes a spring for biasing the presser roller downwardly.

4. The portable carpet binding machine of claim 1 wherein the coacting puller mechanism further includes a clutch being operatively connected to the feed roller for providing intermittent rotation to the feed roller.

5. The portable carpet binding machine of claim 4 wherein the coacting puller mechanism further includes a puller link and rocker arm, the puller link being rotatably connected to an eccentric cam fixedly attached to the drive mechanism, the rocker arm being fixedly attached to the clutch and pivotally connected reative to the puller link such that rotation of the drive mechanism intermittently pushes and pulls the link, the push-pull motion being translated via the rocker arm to rotate the clutch between respective first and second directions, whereby rotation of the clutch in the first direction rotates the feed roller and rotation of the clutch in the second direction provides no motion to the feed roller.

6. The portable carpet binding machine of claim 5 wherein the coacting puller mechanism further includes a rocker shaft, the feed roller being fixedly attached to the rocker shaft, the clutch being operative to engage the shaft in the first direction and disengage the shaft in the second direction.

7. The portable carpet binding machine of claim 1 further including a potentiometer for varying the speed of the prime mover.

8. The portable carpet binding machine of claim 1 wherein the housing is supported on rollers.

9. The portable carpet binding machine of claim 1 wherein the housing supports a finger trigger switch for activating the drive mechanism.

10. The portable carpet binding machine of claim 1 wherein the sewing assembly operates to sew the binding material to the opposite sides of the edge portion of the piece of carpet using a double locked chain stitch.

11. A carpet binding machine comprising:

a) a housing defining an interior region;

b) a drive mechanism supported by the housing and at least partially disposed in the interior region;

c) a prime mover operatively coupled to the drive mechanism for providing motive power to the drive mechanism;

d) a sewing assembly driven via the drive mechanism for stitching a first material to a second material, the sewing assembly including a sewing needle and a looper;

e) the looper including a top and bottom and a tip and heel, wherein the bottom of the looper includes a leaf spring attached thereon near the heel of the looper and extending from the heel to the tip of the looper, the leaf spring flaring away from the bottom of the looper near the tip of the looper;

f) a first thread being threaded through an aperture of the needle and a second thread being threaded through an aperture of the looper;

g) the sewing assembly, when driven, operating to stitch the first material to the second material by interlooping the first and second threads wherein, during at least a part of the interlooping operation, the first thread forms a loop of first thread through which the looper advances such that as the looper retracts from the loop of first thread the leaf spring operates to retard movement of the loop of first thread as the loop of first thread slides towards the tip of the looper; and h) a material feeding assembly driven via the drive mechanism for feeding the first and second materials relative to the sewing assembly.

12. The carpet binding machine of claim 11 wherein the first material is binding material and the second material is carpeting and the binding material is stitched so as to overlie an outer edge of the carpeting.

13. A portable carpet binding machine comprising:

a) a housing defining an interior region;

b) a drive mechanism supported by the housing and at least partially disposed in the interior region;

c) a prime mover operatively coupled to the drive mechanism for providing motive power to the drive mechanism;

d) a sewing assembly driven via the drive mechanism for stitching a first material to a second material, the sewing assembly including a sewing needle and a looper, the needle including a front side, a back side and an aperture near its tip, the looper including an aperture near its tip;

e) a first thread being threaded along the front side of the needle, through the aperture of the needle and along the back side of the needle and a second thread being threaded through the aperture of the looper, the needle being operative during a forward stroke to penetrate through the first material and the second material and move the first thread a predetermined distance below the second material and operative during a return stroke to retract from the first and second materials thereby forming below the second material a loop of first thread; the looper being operative to advance through the loop of first thread;

f) a loop deflector driven via the drive mechanism and operating in proximity to the front side of the needle such that as the needle makes its return stroke the first thread is deflected from passing to the front side of the needle and passes to the back side of the needle, thereby forming the loop of first thread on and extending away from the back side of the needle;

g) the sewing assembly, when driven, operating to stitch the first material to the second material by interlooping the first and second threads; and h) a material feeding assembly driven via the drive mechanism for feeding the first and second materials relative to the sewing assembly.

14. The portable carpet binding machine of claim 13 further including a link and rocker arm, the link being rotatably connected to an eccentric cam fixedly attached to the drive mechanism, the rocker arm being operatively connected to the loop deflector and being pivotally connected relative to the link such that rotation of the drive mechanism intermittently pushes and pulls the link, the push-pull motion being translated via the rocker arm into a rocker motion in the loop deflector.

15. The portable carpet binding machine of claim 14 further including a rocker shaft, the rocker arm and loop deflector being fixedly attached to the rocker shaft so that push-pull motion in the link provides rocker motion in the rocker arm which, in turn, provides simultaneous rocker motion in the rocker shaft and loop deflector attached thereto.

16. The portable carpet binding machine of claim 15 wherein the looper is fixedly attached to the rocker shaft so that the rocker shaft provides rocker motion in the looper in unison with the rocker motion in the loop deflector.

17. The portable carpet binding machine of claim 13 wherein the loop deflector includes a stem portion, the stem portion and looper being angularly spaced apart a gap at least as wide as the distance between the front side and back side of the needle.

18. The portable carpet binding machine of claim 13 wherein the first material is binding material and the second material is carpeting and the binding material is stitched so as to overlie an outer edge of the carpeting.

19. A portable carpet binding machine comprising:

a) a housing defining an interior region;

b) a drive mechanism supported by the housing and at least partially disposed in the interior region;

c) a prime mover operatively coupled to the drive mechanism for providing motive power to the drive mechanism;

d) a sewing assembly driven via the drive mechanism for stitching a first material to a second material, the sewing assembly including a sewing needle, a looper, and a looper thread take-up, a needle thread being threaded through an aperture of the needle and a looper thread being threaded through an aperture of the looper and extending to and being threaded through an aperture of the thread take-up;

e) the drive mechanism being operative to drive the needle in an upward and a downward stroke, the looper in an advance motion and a retraction motion in substantial unison with the respective upward and downward strokes of the needle, and the looper thread take-up in a curved upward and curved downward motion in substantial unison with the respective upward and downward strokes of the needle and a linear forward and a linear return motion in substantial unison with the respective advance and retraction motions of the looper;

f) the looper thread take-up being operative in the curved downward motion to remove remaining slack in the looper thread drawn from a previous sewing cycle and to subsequently draw additional looper thread for a subsequent sewing cycle, in the linear return motion to provide the required slack in the looper thread for the retraction motion of the looper, in the linear forward motion to provide the required slack in the looper thread for the advance motion of the looper, and in the curved upward motion to provide the required slack in the looper thread for completing a sewing cycle;

g) the sewing assembly, when driven, operating to stitch the first material to the second material by interlooping the needle and looper threads; and h) a material feeding assembly driven via the drive mechanism for feeding the first and second materials relative to the sewing assembly.

20. The portable carpet binding machine of claim 19 further including a bell crank mechanism pivotally connected to a bell crank hinge stud and driven by the drive mechanism, the thread take-up being connected to an arm of the bell crank mechanism such that rotation of the bell crank mechanism in a clockwise direction about the hinge stud forces the thread take-up in the curved upward motion and rotation of the bell crank mechanism in a counterclockwise direction forces the thread take-up in the curved downward motion.

21. The portable carpet binding machine of claim 20 further including a stop member attached to an inside wall of the housing and wherein the thread take-up is pivotally connected to the arm of the bell crank mechanism via a pivot pin, the stop member being positioned relative to the thread take-up so that as the thread take-up makes its curved downward motion the thread take-up contacts the stop member, thereby forcing the thread take-up to pivot about the pivot pin in a clockwise direction as the bell crank continues its counterclockwise motion.

22. The portable carpet binding machine of claim 19 wherein the sewing assembly further includes a needle thread take-up and a strike-off wire, the needle thread being threaded through the aperture of the needle and extending to and being threaded through an aperture of the needle thread take-up, the drive mechanism being operative to drive the needle thread take-up in an upward and a downward motion in substantial unison with the respective upward and downward strokes of the needle, the strike-off wire being adjustable to a plurality of positions relative to the needle thread take-up such that, when adjusted to one of the plurality of positions, as the needle thread take-up moves downward, the needle thread contacts the strike-off wire and further downward movement of the needle thread take-up thereafter draws a predetermined amount of needle thread for the subsequent sewing cycle, whereby adjusting the position of the strike-off wire is operative to adjust the predetermined amount of thread to be drawn for the subsequent sewing cycle.

* * * * *